US007827762B2

(12) United States Patent
Griffiths

(10) Patent No.: US 7,827,762 B2
(45) Date of Patent: Nov. 9, 2010

(54) AESTHETIC COVER ASSEMBLY FOR A BUILDING STRUCTURE AND METHOD OF ASSEMBLING SAME

(75) Inventor: Robert T. Griffiths, Elk River, MN (US)

(73) Assignee: Firestone Metal Products, LLC

( * ) Notice: Subject to any disclaimer, the term of this patent is extended or adjusted under 35 U.S.C. 154(b) by 233 days.

(21) Appl. No.: 12/205,479

(22) Filed: Sep. 5, 2008

(65) Prior Publication Data

US 2010/0050568 A1 Mar. 4, 2010

Related U.S. Application Data

(60) Provisional application No. 61/093,170, filed on Aug. 29, 2008.

(51) Int. Cl.
*E04C 3/00* (2006.01)
*F16L 9/00* (2006.01)

(52) U.S. Cl. ..... 52/834; 52/835; 52/844; 52/845; 138/162; 138/155

(58) Field of Classification Search ..... 52/834, 52/835, 843, 844, 845, 854, 847, 36.6; 138/157, 138/162, 165, 166, 169, 155; 256/DIG. 5
See application file for complete search history.

(56) References Cited

U.S. PATENT DOCUMENTS 1,042,579 A * 10/1912 Lucas ..... 138/101
1,541,918 A * 6/1925 Brennan ..... 405/48
2,385,869 A * 10/1945 Lane ..... 405/216
3,459,234 A * 8/1969 Sauter et al. ..... 138/165
4,823,533 A 4/1989 Hillstrom
4,845,912 A * 7/1989 Baker ..... 52/506.09
5,881,528 A * 3/1999 Grewe et al. ..... 52/834
6,009,683 A * 1/2000 Grewe et al. ..... 52/834
6,098,353 A * 8/2000 Stanfield ..... 52/170
6,148,585 A * 11/2000 Baker ..... 52/834
6,192,646 B1 2/2001 Grewe et al.
6,391,414 B1 * 5/2002 Hjertman et al. ..... 428/36.9
6,425,218 B1 7/2002 Doyon et al.
2010/0146901 A1 * 6/2010 Griffiths et al. ..... 52/651.11

OTHER PUBLICATIONS

Detail Sheet for Una-Clad Series 100 Column Cover.
Detail Sheet for Una-Clad Series 200 Column Cover.

* cited by examiner

*Primary Examiner*—Richard E Chilcot, Jr.
*Assistant Examiner*—Branon C Painter
(74) *Attorney, Agent, or Firm*—Sarah M. Jabbari; Faysharpe, LLP

(57) ABSTRACT

A cover segment for an aesthetic cover assembly includes a cover wall and at least one joint element. An aesthetic cover assembly includes two or more cover segments. The joint elements of the cover segments have a common profile and are secured along the corresponding cover wall in an opposite facing relation. A method of assembling a cover assembly is also included.

23 Claims, 5 Drawing Sheets

AESTHETIC COVER ASSEMBLY FOR A BUILDING STRUCTURE AND METHOD OF ASSEMBLING SAME

This application claims priority from U.S. Provisional Patent Application No. 61/093,170 filed on Aug. 29, 2008, which is hereby incorporated herein by reference in its entirety.

BACKGROUND

The subject matter of the present disclosure broadly relates to the art of building structures and, more particularly, an aesthetic cover assembly for concealing a portion of a building structure as well as a method of assembling the same.

Aesthetic cover assemblies are well known and commonly used for concealing features and elements of buildings and/or other structures to thereby enhance the appearance thereof. Such features and elements commonly include vertical supports (e.g., columns), horizontal supports (e.g., beams), mechanical components (e.g., ductwork and piping) and electrical components (e.g., conduit) or any combination of these and/or other features and/or elements. Additionally, such aesthetic cover assemblies are known to be used in both indoor and outdoor environments.

Conventional aesthetic cover assemblies normally include one or more cover segments that are interconnected with one another at a joint. The cover segments normally include one or more cover walls that extend along or around a portion of a building structure to at least partially conceal the same. One or more joint elements are normally secured along a cover wall of each segment to assist in interconnecting the same, such as is disclosed in U.S. Pat. Nos. 4,823,533 and 6,192,646, for example. The joint elements assist in aligning adjacent segments with one another during assembly and/or installation. The joint elements may also be useful in preventing the passage of light between adjacent cover segments to improve the overall appearance of the cover assembly once installed.

Notwithstanding the usage and overall success of known cover assemblies, it is believed desirable to continue to develop and improve the design and construction of aesthetic cover assemblies and methods of assembling the same, such as, for example, to provide improved cosmetic appearance (i.e., fit and finish), ease of installation and reduced installation costs (i.e., field assembly) and/or decreased manufacturing costs.

BRIEF DESCRIPTION

An aesthetic cover assembly in accordance with the subject matter of the present disclosure is provided for use in association with a building structure. The aesthetic cover assembly includes a first segment and a second segment. The first segment includes a first wall and a first joint element. The first wall extends between longitudinally-spaced first and second ends and includes an interior surface at least partially defining an interior cavity of the first segment. The second segment includes a second wall and a second joint element. The second wall extends between longitudinally-spaced first and second ends and includes an interior surface at least partially defining an interior cavity of the second segment. The first and second joint elements have a common cross-sectional profile that includes opposing first and second profile sides and a midline disposed therebetween. Each of the first and second joint elements includes a first element surface extending lengthwise along the first profile side and a second element surface extending lengthwise along the second profile side. The first element surface includes a recess surface disposed on the second profile side of the midline. The first joint element is fixed to the interior surface of the first wall along the first end thereof with the first element surface of the first joint element disposed adjacent the interior surface of the first wall such that a lengthwise slot is at least partially defined between the interior surface of the first wall and the recess surface of the first joint element. The second joint element is fixed to the interior surface of the second wall along the first end thereof. The second element surface of the second joint element is disposed adjacent the interior surface of the second wall with a lengthwise portion of the second joint element projecting beyond the first end of the second wall. The first segment is disposed in approximate alignment with the second segment such that the first end of the first segment and the first end of the second segment are adjacent one another. The lengthwise portion of the second joint element that projects beyond the first end of the second wall is at least partially received within the lengthwise slot.

An aesthetic cover segment in accordance with the subject matter of the present disclosure is provided for use in concealing a portion of an associated building structure. The aesthetic cover segment includes a first section that includes a first wall, a first joint element and a second joint element. The first wall includes an interior surface that at least partially defines a segment cavity for housing a portion of the associated building structure. The first wall also includes opposing first and second ends that are spaced longitudinally from one another. The first and second joint elements have a common cross-sectional profile that includes opposing first and second profile sides and a midline disposed therebetween. Each of the first and second joint elements includes a first element surface extending lengthwise along the first profile side and a second element surface extending lengthwise along the second profile side with the midline extending lengthwise therebetween. The first element surface includes a recess surface portion disposed on the second profile side of the midline. The first joint element is fixed to the interior surface of the first wall along the first end thereof with the first element surface of the first joint element facing the interior surface of the first wall. A lengthwise slot is at least partially defined between the interior surface of the first wall and the recess surface portion of the first joint element. The second joint element is fixed to the interior surface of the first wall along the second end thereof with the second element surface of the second joint element facing the interior surface of the first wall. The second joint element is positioned along the second end of the first wall such that a lengthwise portion of the second joint element projects longitudinally-outwardly beyond the second end of the first wall.

A method of assembling an aesthetic cover in accordance with the subject matter of the present disclosure is provided, such as may be used for concealing a portion of a building structure, for example. The method includes providing first and second joint elements having a common cross-sectional profile. The first and second joint elements include opposing first and second profile sides and a midline disposed therebetween. The first and second joint elements also include a first element surface extending lengthwise along the first profile side and a second element surface extending lengthwise along the second profile side. The first element surface includes a recess surface portion disposed on the second profile side of the midline. The method further includes providing a first wall that extends between longitudinally-spaced first and second ends and includes an interior surface. The method also includes fixing the first joint element to the interior surface of the first wall along the first end thereof such that with the first element surface of the first joint element is disposed adjacent the interior surface of the first wall and thereby forming a lengthwise slot at least partially defined between the interior surface of the first wall and the recess surface portion of the first joint element. The method further includes fixing the second joint element to the interior surface of the first wall along the second end thereof such that the second element surface of the second joint element is disposed adjacent the interior surface and positioning the second joint element along the second end such that a lengthwise portion of the second joint element projects beyond the second end of the first wall.

DETAILED DESCRIPTION

Turning now to the drawings, it is to be understood that the showings are for purposes of illustrating exemplary embodiments only and are not intended to be limiting. Additionally, it will be appreciated that the drawings are not to scale and that portions of certain elements may be exaggerated for the purpose of clarity and ease of illustration.

With reference to FIGS. 1-4, one exemplary embodiment of an aesthetic cover assembly 100 is shown supported along an associated building structure. It will be appreciated that an aesthetic cover assembly, such as cover assembly 100, for example, can be of any suitable size, shape, arrangement and/or configuration. For example, an aesthetic cover assembly can be of any suitable height, length, width and/or diameter. Additionally, the outer form or shape of an aesthetic cover assembly can be approximately planar (e.g., an approximately flat wall section), curvilinear (e.g., cylindrical or frustoconical), rectilinear (e.g., square, triangular or rectangular) or any combination of these and/or other shapes or forms.

Figure 1:
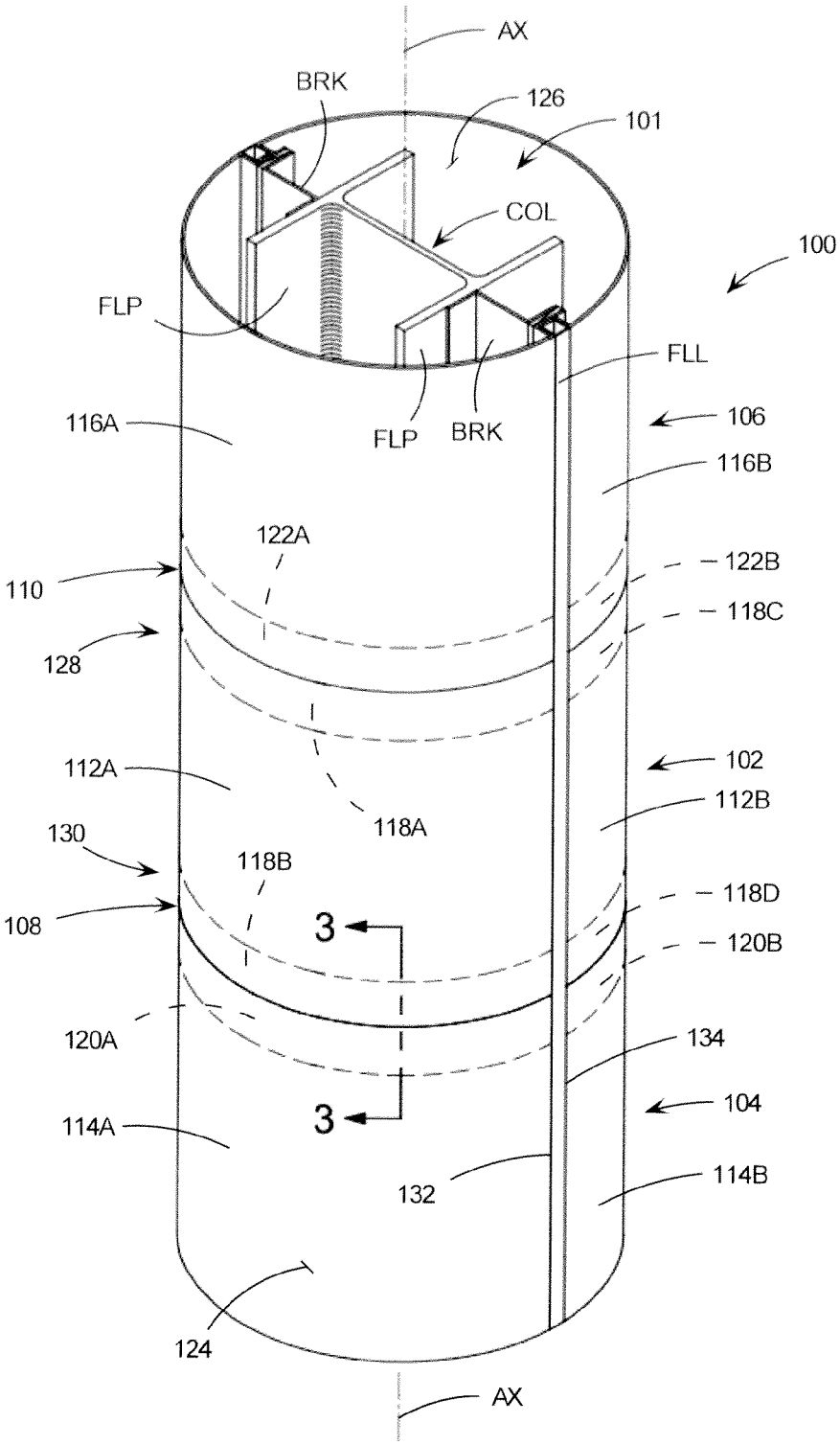
FIG. 1 is a perspective view of one example of an aesthetic cover assembly in accordance with the subject matter of the present disclosure shown concealing a portion of a building structure.
Figure 2:
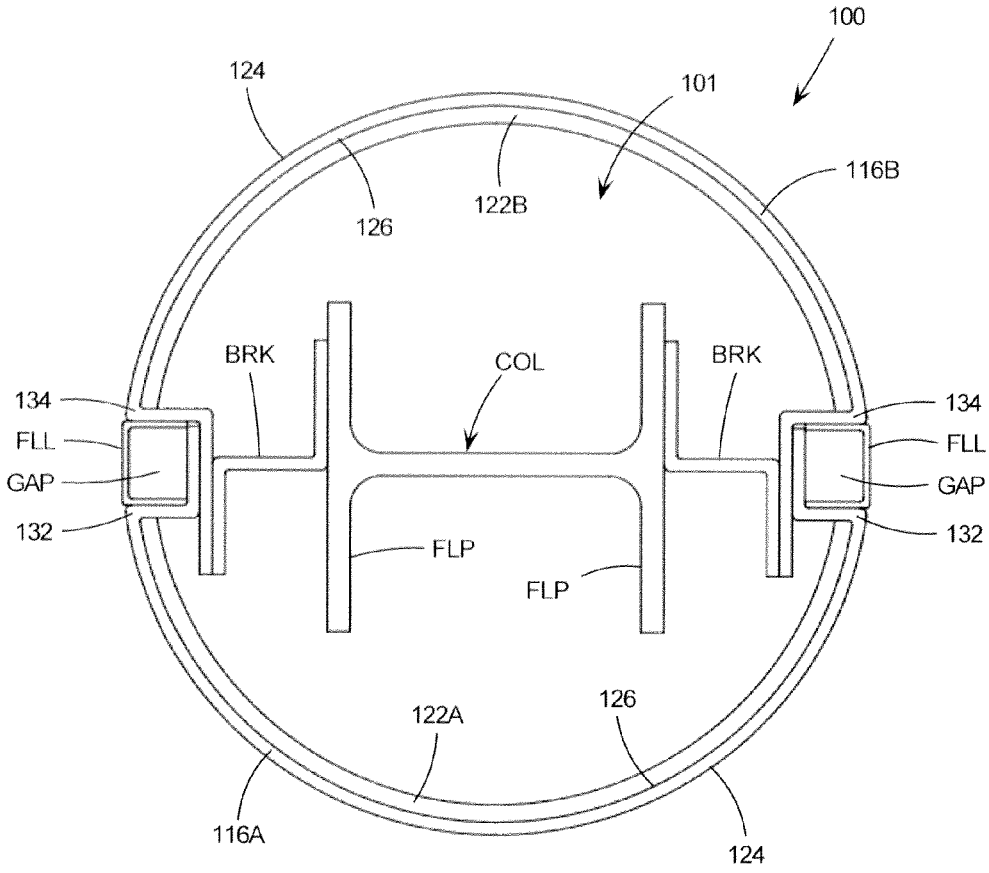
FIG. 2 is a top view of the aesthetic cover assembly and building structure shown in FIG. 1.

In the exemplary arrangement shown in FIGS. 1 and 2, aesthetic cover assembly 100 is shown as being approximately cylindrical and extending longitudinally along an associated building structure, as indicated by axis AX. As discussed above, associated building structures of a great variety of types and kinds may be fully or partially concealed by an aesthetic cover assembly in accordance with the subject matter of the present application, such as structural elements (e.g., walls, columns and beams) and non-structural elements (e.g., plumbing lines, ductwork and electrical conduits). In the exemplary arrangement shown in FIGS. 1 and 2, aesthetic cover assembly 100 forms a cover cavity 101 that conceals a structural column COL, which takes the form of an I-beam. Typically, aesthetic covers are secured to one or more of the components, elements or structural features that are concealed thereby. In the exemplary arrangement shown, braces or mounting brackets BRK are show supported on the opposing flange portions FLP of structural column COL. The mounting brackets extend outwardly from the building structure and engage cover assembly 100. The mounting brackets can be secured on the building structure (e.g., structural column COL) and the aesthetic cover assembly (e.g., cover assembly 100) in any suitable manner, such as may be known in the art.

As indicated above, an aesthetic cover assembly in accordance with the subject matter of the present disclosure can be of any desired length or height and, as such, can include any number of one or more segments of any suitable length or dimension. In the exemplary arrangement shown in FIG. 1, aesthetic cover assembly 100 includes a first segment 102 and an optional second segment 104 disposed longitudinally-adjacent the first segment. An optional third segment 106 is disposed longitudinally-adjacent first segment 102 in the direction generally opposite second segment 104. Additionally, a first joint 108 is shown as being formed between first and second segments 102 and 104, and a second joint 110 is shown as being formed between first and third segments 102 and 106.

An aesthetic cover assembly in accordance with the subject matter of the present disclosure, such as cover assembly 100, for example, will preferably include one or more cover walls and a joint element secured along at least one end of each of the one or more cover walls. In some cases, the cover assembly could be formed from a single wall that is capable of fully concealing the associated building structure. In such case, only one or two joint elements may be used. In other cases, however, each of the one or more cover segments that together form the cover assembly can include two or more cover walls. In such case, each of the two or more cover walls will be capable of partially concealing the associated building structure. The two or more cover walls, when assembled together to form a cover segment, will extend along or around the associated building structure to conceal the same. Additionally, a single joint element could, in some cases, be secured on or along an end of a plurality of cover walls. In a preferred arrangement, however, a joint element will be secured along at least one end of each of the one or more cover walls. In such case, each individual cover wall and joint element assembly may be referred to as a cover section. A plurality of cover sections can then be assembled together to form or otherwise act as a cover segment. Or, in a case where only one cover segment is being used, the plurality of cover sections can be assembled together to form or otherwise act as the overall aesthetic cover assembly.

In the exemplary arrangement shown in FIGS. 1 and 2, each of segments 102, 104 and 106 includes two cover walls, which are respectively identified by reference numbers 112A and 112B, 114A and 114B, and 116A and 116B. Additionally, each cover wall includes a joint element extending along at least one end thereof. In the exemplary arrangement shown, both of cover walls 112A and 112B include a joint element disposed along each of the two opposing longitudinally-spaced ends thereof, as indicated by reference numbers 118A-D. However, cover walls 114A and 114B as well as cover walls 116A and 116B are each shown as including a joint element disposed along only one of the two longitudinally-spaced ends thereof, as indicated by reference numbers 120A, 120B, 122A and 122B, respectively. As such, each of cover segments 102, 104 and 106 is formed from two cover sections (not numbered).

Additionally, each cover wall that is used to at least partially form a cover segment (e.g., cover segments 102, 104 and 106) includes an exterior surface 124 (numbered on cover segment 104 only), an opposing interior surface 126 (numbered on cover segment 106 only), opposing first and second longitudinally-spaced ends 128 and 130 (numbered on cover segment 102 only), and opposing longitudinally-extending edges 132 and 134 (numbered on cover segment 104 only). It will be appreciated that each cover wall will have opposing surfaces and that, regardless of the shape or configuration of the cover wall, one of these opposing surfaces will, in use, act as the outward or visible surface and the other of the opposing surfaces will act as the inward or hidden surface.

Where two or more laterally-adjacent cover sections are used, such as is shown in FIGS. 1 and 2, for example, the two or more cover sections can be joined or otherwise interconnected in any suitable manner, as is well known in the art. Optionally, a suitable cosmetic filler element FLL can be inserted or otherwise secured on or along the joint. In the exemplary arrangement shown in FIGS. 1 and 2, filler elements FLL are shown as being inserted into longitudinally-extending gaps GPS formed between edges 132 and 134 of cover walls 116A and 116B. However, it will be appreciated that any other suitable arrangement could alternately be used.

It will be appreciated that the first and second joint elements that are secured along ends of adjacent cover walls (or, alternatively, opposing ends of a single cover wall) can take any suitable shape, form and/or configuration and that the arrangement shown and described herein is merely exemplary. However, the first and second joint elements will preferably share a common cross-sectional profile or overall cross-sectional shape. While it will be appreciated that the first and second joint elements can be formed in any suitable manner and by using any suitable processes or methods of manufacture, the first and second joint elements could, as one example, be extruded from a common die such that the cross-sectional profiles thereof would be substantially identical. In such case, the first and second joint elements could simply be formed from two different sections or pieces of a single length of extruded material.

Figure 3:
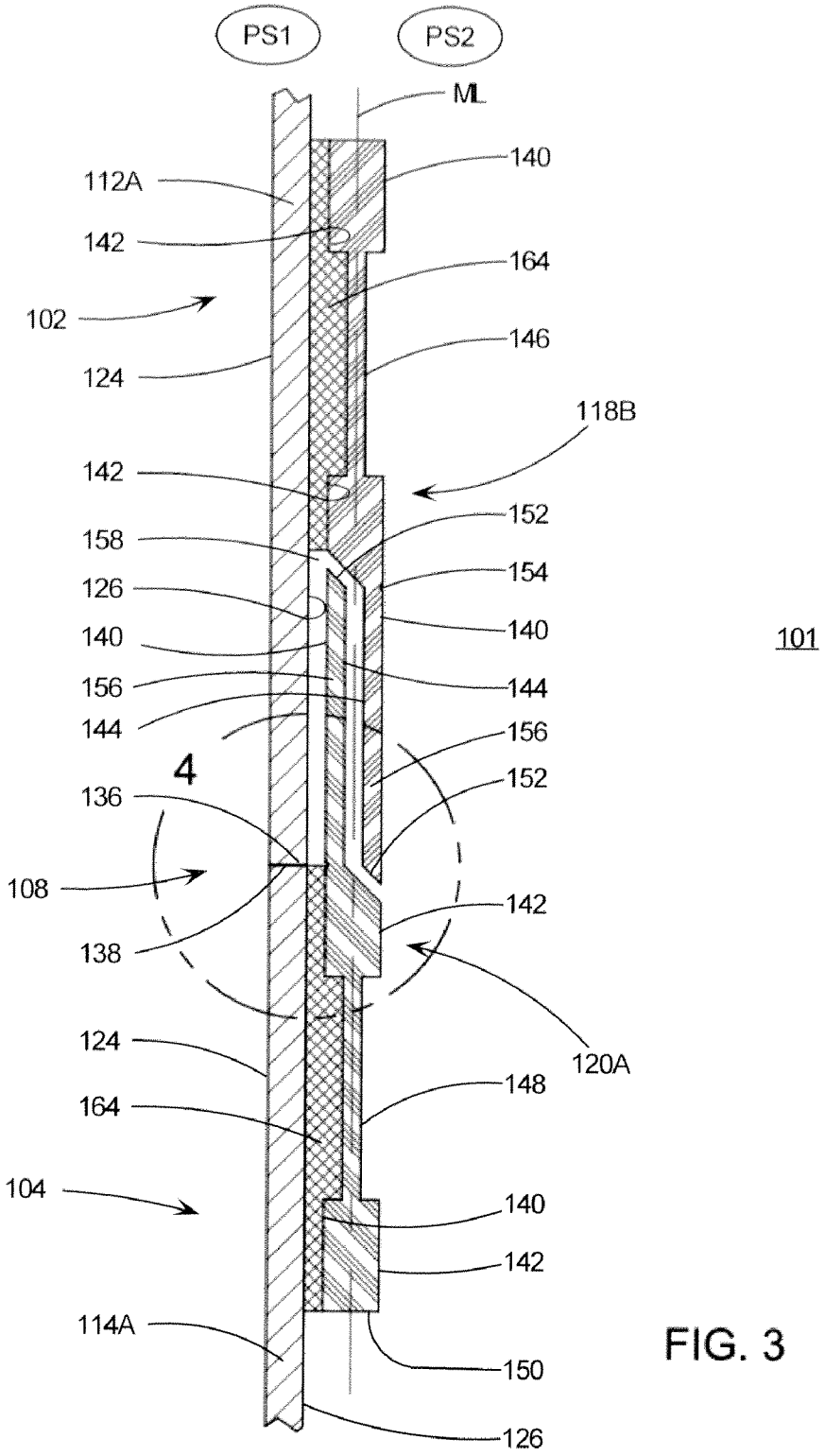
FIG. 3 is a cross-sectional side view of the aesthetic cover assembly in FIGS. 1 and 2 taken along line 3-3 in FIG. 1.
Figure 4:
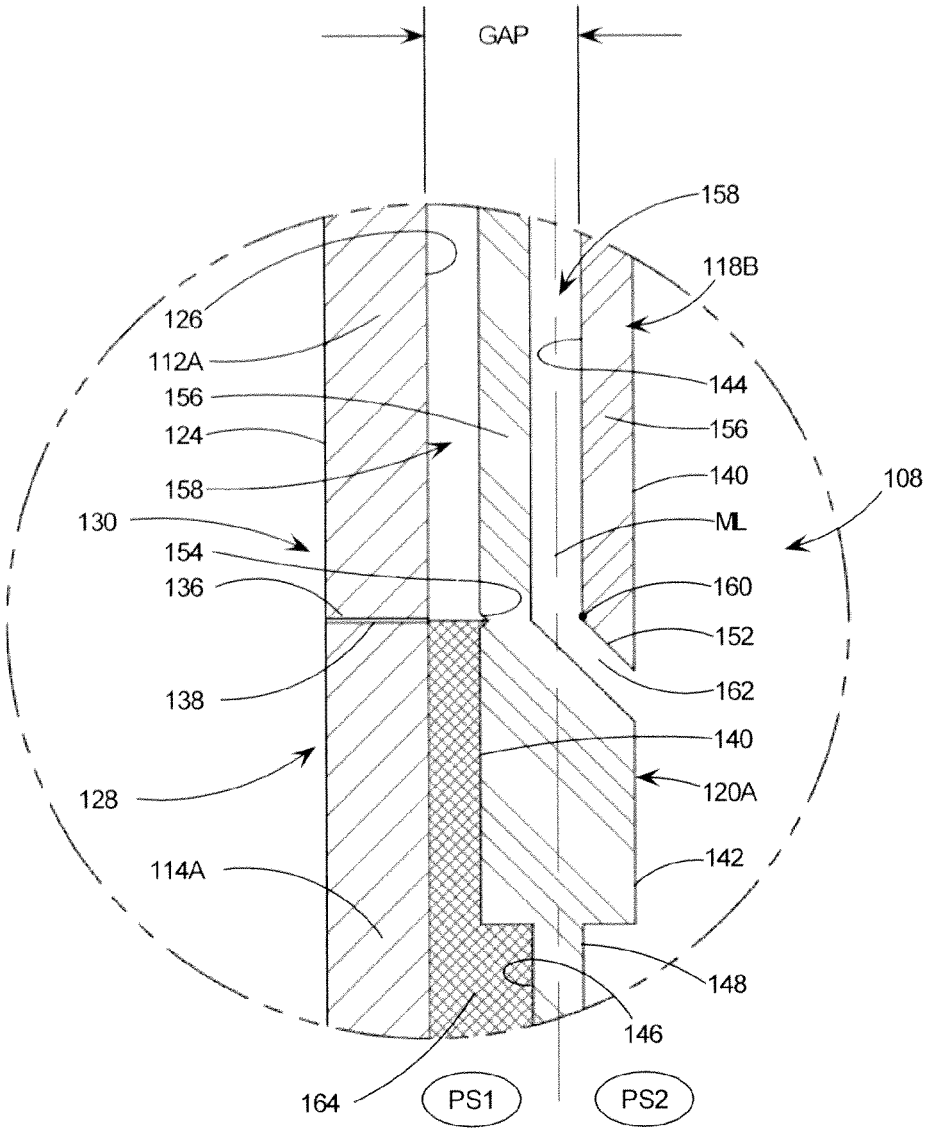
FIG. 4 is an enlarged view of the portion of the aesthetic cover assembly in Detail 4 of FIG. 3.

One example of a joint formed between adjacent segments of an aesthetic cover assembly that includes first and second joint elements that are formed from a common cross-sectional profile is shown in FIGS. 3 and 4. As shown therein, first cover segment 102 and second cover segment 104 are disposed in longitudinally-adjacent relation to one another such that second (or lower) end 130 of the first cover segment is disposed adjacent first (or upper) end 128 of the second cover segment. It will be appreciated that each of the cover walls of an aesthetic cover assembly will also include longitudinally-spaced edges that are disposed along respective ones of the longitudinally-spaced ends. As shown in FIGS. 3 and 4, one of the longitudinally-spaced edges of cover wall 112A is identified by reference number 136 and one of the longitudinally-spaced edges of cover wall 114A is identified by reference number 138. Edges 136 and 138 are shown in FIGS. 3 and 4 as being immediately adjacent one another. In practice, some minor imperfections and inconsistencies may be found along the longitudinally-spaced edges of a cover wall. As such, adjacent edges of adjacent cover walls, such as edges 136 and 138, for example, would be expected to abuttingly engage one another along some lengthwise portions thereof and be slightly spaced from one along other lengthwise portions of the edges. As such, edges 136 and 138 are shown as being slightly spaced apart from one another, which also improves and clarifies identification of the edges for purposes of discussion.

As can be observed from FIG. 3, first and second joint elements 118B and 120A are formed from a common cross-sectional profile that includes first and second profile sides PS1 and PS2 that extend lengthwise along the joint elements and are disposed on opposing sides of a lengthwise-extending midline ML. For purposes of simplicity and clarity of explanation, first and second profile sides PS1 and PS2 will specifically refer to the geometric sides associated with second joint element 120A. Thus, as can be further observed from FIG. 3, first profile side PS1 of second joint element 120A is disposed in facing relation to interior surface 126 of cover wall 114A. Whereas, second profile side PS2 of first joint element 118A is disposed in facing relation to interior surface 126 of cover wall 112A.

With more specific reference to the common cross-sectional profile of the first and second joint element, second joint element 120A will be discussed in greater detail. However, it is to be specifically understood that the features, element and/or portions of the cross-sectional profile described in particular reference to the second joint element will be the same or at least substantially similar for any of the one or more other joint elements (e.g., joint elements 118A, 118B, 120B, 122A and 122B) that may be included in an aesthetic cover assembly in accordance with the subject matter of the present disclosure, such as cover assembly 100, for example.

The common cross-sectional profile of the joint elements includes a first profile surface 140 disposed along first profile side PS1 and a second profile surface 142 disposed along second profile side PS2. However, it will be appreciated that a portion of second profile surface 142 is disposed along the opposite side of midline ML (i.e., along first profile side PS1). This portion of second profile surface 142 is referred to as a recess surface or recess surface portion and is identified in FIGS. 3 and 4 by reference number 144. Optionally, one or more recesses can be formed on or along either or both of the first and second profile surfaces. For example, opposing recesses 146 and 148 can be provided on the common cross-sectional profile, such as along respective first and second profile surfaces 140 and 142 thereof, for example. Such opposing recesses, if provided, can extend lengthwise along the full extent of the joint elements or any lesser portion thereof. It will be appreciated, however, that recesses of any other suitable shape, size, arrangement and/or configuration could alternately or additionally be used. Furthermore, any number of one or more through-holes (not shown) or other passages (not shown), such as may extend from along one profile side to the other, can also optionally be provided.

The common cross-sectional profile of the joint elements also includes lengthwise-extending end portions (not numbered) that are longitudinally-spaced from one another, such as with respect to longitudinal axis AX (FIG. 1). It will be appreciated that first and second side surfaces 140 and 142 can be interconnected in any suitable manner along the lengthwise-extending end portions. For example, a first lengthwise-extending end wall or surface 150 is disposed approximately transverse to the first and second side surfaces. As another example, a second length-wise extending end wall 152 interconnects recess surface portion 144 of second profile surface 142 with first profile surface 140. As can be observed from FIGS. 3 and 4, end wall 152 is disposed at an angle with respect to the first and second profile surfaces and, thus, forms chamfer-type feature that extends lengthwise along one of the longitudinally-spaced ends of the joint elements. Furthermore, an alignment feature can optionally be provided on the joint elements, such as for visually aligning a joint element with an edge of an associated cover wall, for example. In one exemplary arrangement, a notch 154 can be provided in the common cross-sectional profile, such as along first profile side PS1 thereof, for example, to form a lengthwise-extending alignment feature on the joint elements.

It will be appreciated that a joint element in accordance with the subject matter of the present disclosure can extend lengthwise along the entire longitudinally-spaced end of a cover wall or any lesser portion thereof, such as may desired. Additionally, it will be appreciated that the joint elements can be formed from any suitable material or combination of materials, such as metal, plastic or a reinforced fiber composite material, for example. In the preferred embodiment, the joint elements are from aluminum. However, any other suitable material could alternately be used. Furthermore, it will be appreciated that the cover wall or walls can be formed from any suitable material or combination of materials, such as metal, plastic or a composite walls structure, for example.

As discussed above, the joint elements (e.g., joint elements 118A, 118B, 120A, 120B, 122A and 122B) that form a joint (e.g., joints 108 and 110) between adjacent segments (e.g., segments 102, 104 and 106) are oriented along the cover walls (e.g., 112A, 112B, 114A, 114B, 116A and 116B) of the respective cover segments in a mirrored or book-matched arrangement. As such, a portion 156 of the common cross-sectional profile between recess surface portion 144 and first profile surface 140 forms a lengthwise extending wall on one joint element (e.g., joint element 120A) that is disposed outwardly from the same portion (i.e., portion 156) of the other joint element (e.g., 118B), which is disposed inwardly therefrom. This arrangement allows the two joint elements to interengage one another to thereby at least approximately align the corresponding cover segments with one another. In this arrangement, the inwardly disposed portion acts to form a gap between recess surface portion 144 and interior surface 126 of the associated cover wall (e.g., cover wall 112A), such as is represented by dimension GAP in FIG. 4, for example. This gap, in turn, results in the formation of a lengthwise-extending slot or groove 158 between the joint element and the cover wall. Furthermore, the outwardly disposed portion acts as a rib or lengthwise-extending projection that is received within the lengthwise-extending groove, such as, for example, to assist in aligning and/or maintaining the alignment of the exterior surface (e.g., surface 124) of the adjacent cover walls with one another.

The joint elements that form a joint between adjacent cover segments, as discussed above, are preferably disposed along an end (e.g., one of longitudinally-spaced ends 128 and 130) of the cover wall of the respective cover segment so that the two corresponding joint elements can interengage one another as discussed above. While it will be appreciated that any suitable arrangement can alternately be use, in one preferred arrangement, the joint elements are at least approximately aligned along an end of the corresponding cover wall in relation to an associated edge thereof. For example, joint element 118B can be disposed lengthwise along end 130 of cover wall 112A such that a portion, area or feature of the joint element, such as an end 160 of end wall 152, for example, is at least approximately aligned with edge 136 of the cover wall. As another example, joint element 120A can be disposed lengthwise along end 128 of cover wall 114A such that a portion, area or feature of the joint element, such the alignment feature formed by notch 154, for example, is at least approximately aligned with edge 138 of the cover wall. In such case, portion 156 of joint element 120A will project longitudinally-outwardly beyond edge 138, such that the rib or lengthwise-extending projection formed thereby can be received in lengthwise-extending slot 158. In that the joint (e.g., joint 108 and/or 110) is not intended to provide axial (i.e., longitudinal) support to the adjacent cover segments (e.g., segments 102, 104 and 106), a gap or space 162 can remain between the two joint elements. Furthermore, it will be appreciated that the joint elements can be secured on or along the interior surface of the cover wall in any suitable manner and by using any suitable method of securement, such as threaded fasteners, retaining clips or flowed-material joints (e.g., welds), for example. In one preferred arrangement, an adhesive substance or material 164 is used to affix the joint element on or along the cover wall.

Figure 5:
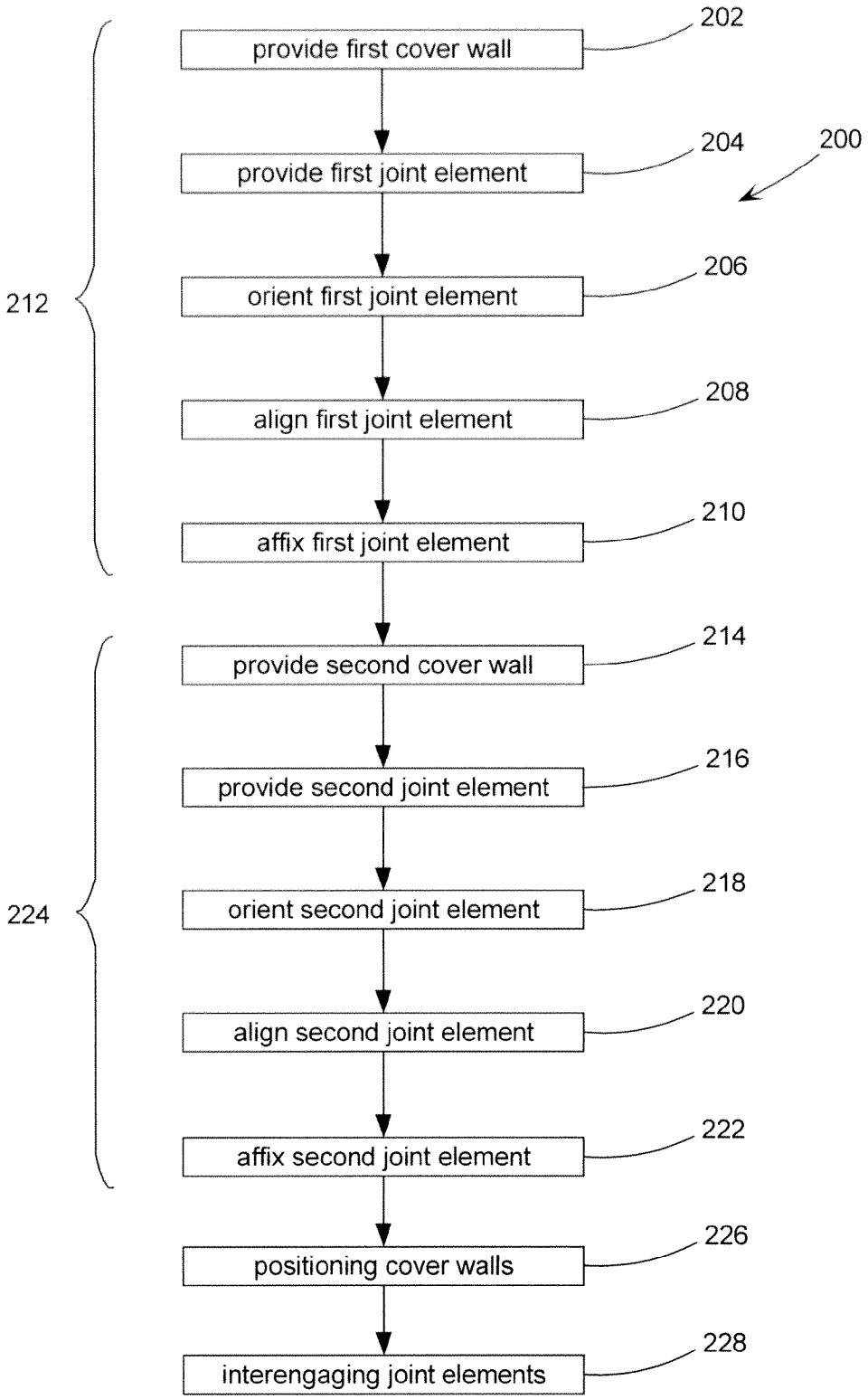
FIG. 5 is a graphical representation of one exemplary method of assembling an aesthetic cover assembly in accordance with the subject matter of the present disclosure.

Turning now to FIG. 5, one exemplary method 200 of assembling a cover assembly in accordance with the subject matter of the present disclosure is shown. Method 200 includes providing a first cover wall, such as one of cover walls 112A, 112B, 114A, 114B, 116A and 116B, for example, as is indicated by box 202. Method 200 also includes providing a first joint element having a cross-sectional profile, such as one of joint elements 118A, 118B, 120A, 120B, 122A and 122B, for example, as is indicated by box 204. Method 200 further includes orienting the first joint element such that a first side of the cross-sectional profile, such as first profile side PS1, for example, is disposed toward a surface of the first cover wall, as is indicated by box 206. Method 200 also includes aligning a feature of the first joint element with a feature of the cover wall and attaching, securing or otherwise affixing the first joint element to the cover wall in the approximately aligned condition, as is respectively indicated by boxes 208 and 210. Actions 202-210 can act to form a cover segment (e.g., one of segments 102, 104 and 106) or a portion thereof (i.e., a cover section), as is indicated by reference number 212.

As shown in and discussed above with regard to FIG. 1, a cover segment can include any number of one or more joint elements secured along an end of the cover wall thereof. That is, a cover segment can include a cover wall with only one joint element secured along an end thereof, such as cover segments 104 and 106, for example. Alternatively, a cover segment can include a cover wall with one or more joint elements secured along each of the opposing ends thereof, such as cover segment 102, for example. As such, method 200 can optionally include providing a second cover wall, as indicated by box 214. In such case, the actions discussed hereinafter would be directed to the assembly of a second cover segment or portion thereof.

In the alternative, method 200 can include providing a second joint element having a cross-sectional profile that is common with or otherwise substantially identical to the cross-sectional profile of the first joint element, as is indicated by box 216. Method 200 can also include orienting the second joint element such that a second side of the cross-sectional profile, such as second profile side PS2, for example, is disposed toward the same surface of the cover wall as the first joint element, as is indicated by box 218. Method 200 can further include aligning a feature of the second joint element with a feature of the cover wall and attaching, securing or otherwise affixing the second joint element to the cover wall in the approximately aligned condition, as is respectively indicated by boxes 220 and 222. Where a second cover wall is optionally included, as indicated by box 214, actions 214-222 can act to form a second cover segment (e.g., one of segments 102, 104 and 106) or a portion thereof (i.e., a cover section), as is indicated by reference number 224. In such case, method 200 can also, optionally, include positioning the two cover segments adjacent one another, as indicated by box 226, and interengaging the joint elements thereof to approximately align the two cover segments with one another, as indicated by box 228.

As used herein with reference to certain elements, components and/or structures (e.g., "first joint element" and "second joint element"), numerical ordinals merely denote different singles of a plurality and do not imply any order or sequence unless specifically defined by the claim language.

While the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles of the subject matter of the present disclosure. For example, the disclosed embodiments could be altered to utilize such joint elements on cover assemblies of a square or hexagonal shape, or any other uniform or non-uniform building structure. Additionally, such building structures can be vertical columns, horizontal supports and any other load bearing or non-load bearing features regardless of orientation. Furthermore, the disclosed embodiments could also be used on walls, ceilings or other approximately planar applications as well as on or along wall-wall corners and wall-ceiling corners. Thus, modifications and alterations will occur to others upon reading and understanding the preceding detailed description. Accordingly, it is to be distinctly understood that the foregoing descriptive matter is to be interpreted merely as illustrative and not as a limitation. As such, it is intended that the subject matter of the present disclosure be construed as including all such modifications and alterations insofar as they come within the scope of the appended claims and any equivalents thereof.

The invention claimed is:

1. An aesthetic cover assembly for a building structure, said aesthetic cover assembly comprising:

a first segment including a first wall and a first joint element, said first wall extending between longitudinally-spaced first and second ends and including an interior surface at least partially defining an interior cavity of said first segment; and, a second segment including a second wall and a second joint element, said second wall extending between longitudinally-spaced first and second ends and including an interior surface at least partially defining an interior cavity of said second segment;

said first and second joint elements having a common cross-sectional profile that includes opposing first and second profile sides and a midline disposed therebetween, each of said first and second joint elements including a first element surface extending lengthwise along said first profile side and a second element surface extending lengthwise along said second profile side, said first element surface including a recess surface disposed on said second profile side of said midline;

said first joint element fixed to said interior surface of said first wall along said first end thereof with said first element surface of said first joint element disposed adjacent said interior surface of said first wall such that a lengthwise slot is at least partially defined between said interior surface of said first wall and said recess surface of said first joint element;

said second joint element fixed to said interior surface of said second wall along said first end thereof with said second element surface of said second joint element disposed adjacent said interior surface of said second wall and with a lengthwise portion of said second joint element projecting beyond said first end of said second wall; and said first segment disposed in approximate alignment with said second segment such that said first end of said first segment and said first end of said second segment are adjacent one another and such that said lengthwise portion of said second joint element projecting beyond said first end of said second wall is at least partially received within said lengthwise slot.

2. An aesthetic cover assembly according to claim 1, wherein said first wall is one of a plurality of first walls forming said first segment, and each of said plurality of first walls includes an interior surface at least partially defining said interior cavity of said first segment.

3. An aesthetic cover assembly according to claim 2, wherein said first joint element is one of a plurality of first joint elements of said first segment, said plurality of first joint elements having said common cross-sectional profile and being fixed to said interior surface of at least one of said plurality of first walls such that said first element surface of said plurality of first joint elements is disposed adjacent said interior surface of said at least one of said plurality of first walls.

4. An aesthetic cover assembly according to claim 2, wherein said second wall is one of a plurality of second walls forming said second segment, and each of said plurality of second walls includes an interior surface at least partially defining said interior cavity of said second segment.

5. An aesthetic cover assembly according to claim 1, wherein said first segment includes a third joint element having said common cross-sectional profile and being fixed to said interior surface of said first wall along said second end thereof and in longitudinally-spaced relation to said first joint element.

6. An aesthetic cover assembly according to claim 5, wherein said first element surface of said third joint element is disposed adjacent said interior surface of said first wall such that a lengthwise slot is at least partially defined between said interior surface of said first wall and said recess surface of said third joint element.

7. An aesthetic cover assembly according to claim 5, wherein said second element surface of said third joint element is disposed adjacent said interior surface of said first wall with a lengthwise portion of said third joint element projecting beyond said second end of said first wall.

8. An aesthetic cover assembly according to claim 7 further comprising a third segment including a third wall and a fourth joint element, said third wall extending between longitudinally-spaced first and second ends and including an interior surface at least partially defining an interior cavity of said third segment, said fourth joint element having said common cross-sectional profile and being fixed to said interior surface of said third wall along said first end thereof, said third segment disposed in approximate alignment with said first segment such that said first end of said third segment and said second end of said first segment are adjacent one another.

9. An aesthetic cover assembly according to claim 8, wherein said first element surface of said fourth joint element is disposed adjacent said interior surface of said third wall such that a lengthwise slot is at least partially defined between said interior surface of said third wall and said recess surface of said fourth joint element, and with said lengthwise portion of said third joint element projecting beyond said second end of said first wall being at least partially received within said lengthwise slot of said third segment.

10. An aesthetic cover segment for concealing a portion of an associated building structure, said aesthetic cover segment comprising:

a first section including a first wall, a first joint element and a second joint element, said first wall including an interior surface that at least partially defines a segment cavity for housing a portion of the associated building structure, said first wall including opposing first and second ends spaced longitudinally from one another;

said first and second joint elements having a common cross-sectional profile that includes opposing first and second profile sides and a midline disposed therebetween, each of said first and second joint elements including a first element surface extending lengthwise along said first profile side and a second element surface extending lengthwise along said second profile side with said midline extending lengthwise therebetween, said first element surface including a recess surface portion disposed on said second profile side of said midline;

said first joint element fixed to said interior surface of said first wall along said first end thereof with said first element surface of said first joint element facing said interior surface of said first wall such that a lengthwise slot is at least partially defined between said interior surface of said first wall and said recess surface portion of said first joint element; and said second joint element fixed to said interior surface of said first wall along said second end thereof with said second element surface of said second joint element facing said interior surface of said first wall, said second joint element positioned along said second end of said first wall such that a lengthwise portion of said second joint element projects longitudinally-outwardly beyond said second end of said first wall.

11. An aesthetic cover segment according to claim 10 further comprising a second section including a second wall, a third joint element and a fourth joint element;

said second wall including an interior surface that at least partially defines said segment cavity for housing a portion of the associated building structure, and said second wall including opposing first and second ends spaced longitudinally from one another;

said third and fourth joint elements having said common cross-sectional profile;

said third joint element fixed to said interior surface of said second wall along said first end such that said first element surface is facing said interior surface of said second wall to thereby form a lengthwise slot between said interior surface of said second wall and said recess surface portion of said third joint element; and, said fourth joint element fixed to said interior surface of said second wall along said second end such that said second element surface is facing said interior surface of said second wall and with said fourth joint element positioned relative to said second end such that a lengthwise portion of said fourth joint element projects longitudinally outwardly beyond said second wall.

12. An aesthetic cover segment according to claim 11, wherein said first and second walls each include opposing first and second longitudinally-extending edges, and said first and second sections are positioned relative to one another such that said first and second edges of said first wall are respectively disposed adjacent said first and second edges of said second wall to thereby at least partially form said cover segment.

13. An aesthetic cover segment according to claim 10, wherein said first wall, said first joint element and said second joint element are all either curved about a longitudinally-extending axis or substantially planar in a direction generally transverse to a longitudinal direction.

14. An aesthetic cover segment according to claim 13, wherein said midplane of each of said first and second joint elements has approximately the same radius of curvature, but with the radius of curvature of said first element surface being greater for said first joint element than for said second joint element.

15. An aesthetic cover segment according to claim 10, wherein said common cross-sectional profile includes an alignment feature extending lengthwise along said first and second joint elements, and said alignment feature of one of said first and second joint elements is disposed in approximate alignment with a respective one of said first and second ends of said first wall.

16. An aesthetic cover segment according to claim 10 further comprising an adhesive substance disposed between said interior surface of said first wall and said first and second joint elements for securing said first and second joint elements along said first wall.

17. A method of assembling an aesthetic cover for concealing a portion of a building structure, said method comprising:

a) providing first and second joint elements having a common cross-sectional profile, said first and second joint elements including opposing first and second profile sides and a midline disposed therebetween, said first and second joint elements including a first element surface extending lengthwise along said first profile side and a second element surface extending lengthwise along said second profile side, said first element surface including a recess surface portion disposed on said second profile side of said midline;

b) providing a first wall that extends between longitudinally-spaced first and second ends and includes an interior surface;

c) fixing said first joint element to said interior surface of said first wall along said first end thereof such that said first element surface of said first joint element is disposed adjacent said interior surface of said first wall and thereby forming a lengthwise slot at least partially defined between said interior surface of said first wall and said recess surface portion of said first joint element; and, d) fixing said second joint element to said interior surface of said first wall along said second end thereof such that said second element surface of said second joint element is disposed adjacent said interior surface and positioning said second joint element along said second end such that a lengthwise portion of said second joint element projects beyond said second end of said first wall.

18. A method according to claim 17 further comprising:

e) providing a second wall that extends between longitudinally-spaced first and second ends and includes an interior surface;

f) providing third and fourth joint elements having said common cross-sectional profile and including said first and second profile sides with a first element surface extending lengthwise along said first profile side, a second element surface extending lengthwise along said second profile side and a midline disposed between said first and second profile sides, said first element surface including a recess surface portion disposed on said second profile side of said midline;

g) fixing said third joint element to said interior surface of said second wall along said first end thereof such that said first element surface of said third joint element is disposed adjacent said interior surface of said second wall and thereby forming a lengthwise slot at least partially defined between said interior surface of said second wall and said recess surface portion of said third joint element; and, h) fixing said fourth joint element to said interior surface of said second wall along said second end thereof such that said second element surface of said fourth joint element is disposed adjacent said interior surface of said second wall and positioning said fourth joint element along said second end such that a lengthwise portion of said fourth joint element projects beyond said second end of second wall.

19. A method according to claim 18 further comprising:

orienting said first and second walls relative to one another such that said first end of said first wall and said second end of said second wall are adjacent one another and said interior surfaces of said first and second walls are approximately aligned with one another; and, receiving said lengthwise portion of said fourth joint element within said lengthwise slot between said first wall and said first joint element.

20. A method according to claim 18, wherein said first and second walls each include first and second longitudinally-extending edges, and said method further comprises orienting said first and second walls relative to one another such that said first edges and said second edges are adjacent one another and such that said interior surfaces thereof are disposed toward one another to thereby define an interior cavity of a cover segment.

21. A method according to claim 17, wherein providing first and second joint elements in a) includes providing an alignment feature extending lengthwise along said first and second joint elements, and said method further comprises approximately aligning said alignment feature of said second joint element with said second end of said first wall.

22. A method according to claim 17 further comprising at least approximately aligning a lengthwise edge of said first joint element with said first end of said first wall.

23. A method according to claim 17, wherein at least one of fixing said first joint element in c) and fixing said second joint element in d) includes securing said joint element along said interior surface using adhesive.

* * * * *